US011034513B2

(12) United States Patent
Gavin

(10) Patent No.: US 11,034,513 B2
(45) Date of Patent: Jun. 15, 2021

(54) UNIVERSAL REPLACEMENT BOTTOM ASSEMBLY KIT FOR COMMERCIAL WASTE CONTAINERS

(71) Applicant: Plastic Recovery Technologies Corporation, Schaumburg, IL (US)

(72) Inventor: Kevin Paul Gavin, Northbrook, IL (US)

( * ) Notice: Subject to any disclaimer, the term of this patent is extended or adjusted under 35 U.S.C. 154(b) by 0 days.

(21) Appl. No.: 17/247,410

(22) Filed: Dec. 10, 2020

(65) Prior Publication Data

US 2021/0147144 A1 May 20, 2021

Related U.S. Application Data

(63) Continuation of application No. 16/684,293, filed on Nov. 14, 2019.

(51) Int. Cl.
*B65F 1/14* (2006.01)

(52) U.S. Cl.
CPC ..... *B65F 1/14* (2013.01); *B65F 2250/112* (2013.01)

(58) Field of Classification Search
CPC B65F 1/14; B65F 2250/112; B65F 2210/132; B65F 2220/101; B65F 1/02; B65D 25/38
USPC ..... 220/23.88, 600, 625, 622, 1.5, 908
See application file for complete search history.

(56) References Cited

U.S. PATENT DOCUMENTS 5,083,827 A * 1/1992 Hollenbaugh, Sr. .... B60R 13/01 220/4.08
5,671,862 A * 9/1997 Cobos ..... B65F 1/02 220/622
6,102,086 A * 8/2000 Holtby ..... F16N 31/006 141/311 A
6,634,541 B1 10/2003 Hankey et al.
8,944,276 B2 2/2015 Garagiola
9,567,159 B2 2/2017 Loney et al.

FOREIGN PATENT DOCUMENTS

WO WO9405554 * 3/1994 ..... B65D 25/38

* cited by examiner

*Primary Examiner* — James N Smalley
*Assistant Examiner* — Elizabeth J Volz
(74) *Attorney, Agent, or Firm* — Stonebridge IP, PLLC

(57) ABSTRACT

The present disclosure relates to a commercial waste container bottom assembly kit, capable of fitting a wide range of waste container and dumpster sizes. The system includes additional features such as an enhanced commercial waste container load rail and joggled end caps. The advantages over traditional methods of replacing container bottoms are significant.

19 Claims, 6 Drawing Sheets

UNIVERSAL REPLACEMENT BOTTOM ASSEMBLY KIT FOR COMMERCIAL WASTE CONTAINERS

CROSS REFERENCE TO RELATED APPLICATIONS

This application is a continuation application under 35 USC § 120 of U.S. application Ser. No. 16/684,293, filed on Nov. 14, 2019 which is herein incorporated by reference in its entirety.

BACKGROUND OF THE DISCLOSURE

Field of the Invention

The present disclosure relates to a universal replacement assembly kit and system for refurbishing commercial waste containers or dumpsters.

Description of the Related Art

Commercial waste containers, including dumpsters, are presently in use by a variety of establishments. It has not always been appreciated, however, that the bottom of a dumpster suffers the most wear and damage during normal use. Accordingly, very little has been done in terms of the development of a universal replacement bottom for a dumpster. This would allow an existing dumpster to be refurbished achieving a significantly longer lifetime, and which would provide significant environmental benefits and long-term cost savings.

The body of commercial waste containers or dumpsters can last ten to twelve years but because of the combined weight of a full container and real life working conditions of lifting to transfer waste to a haul vehicle and the subsequent placement of the container on the ground, there are several high-wear parts on a container including the base or bottoms. Additionally, waste contents with high acid and/or salt content will accelerate the need to replace the steel bottom. Over the course of the life of a container, a container may be refurbished with the replacement of high wear parts including the bottoms.

The existing way to refurbish a container bottom is to replace with a bottom that is the exact size of the container to be refurbished. While there are some industry standard sizes for commercial waste containers, but there are hundreds of variations. Due to the weight and the associated cost of shipping long distances, container fabricators are generally regionally located, and regional differences in shapes and features also apply.

The current state of the art includes a significant number of types and sizes of commercial waste containers or dumpsters and highlights the significant complexity of refurbishing defective bottoms for commercial waste containers or dumpsters due to the various designs and sizes currently in use.

SUMMARY OF THE INVENTION

It is an object of the present disclosure to provide a replacement bottom kit and system that is adaptable to a wide range of designs, makes, and sizes of commercial waste containers or dumpsters that are currently in use. This would significantly reduce the complexity and cost of the refurbishing process and provide significant long-term environmental benefits.

This and other objects may be achieved by providing a two-piece base assembly which can be adjusted to fit a wide variety of commercial waste containers. Currently, the only way to replace the bottom of a commercial waste container is to fabricate a specific-sized base or bottoms and then to affix the base or bottom to the commercial waste container to be refurbished after the defective bottom has been removed.

There are hundreds of variations of commercial waste containers in use. A Universal Replacement Kit will substantially reduce the complexity of the refurbishing process and significantly reduce the cost. Furthermore, significant environmental benefits will be achieved by extending the lifetime of existing commercial waste containers and dumpsters.

Furthermore, in one embodiment, the design will allow the waste container bottom replacement kit to be nested in a compact configuration which will substantially reduce the size of a kit for shipping, and substantially reduce shipping cost.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, products, and/or systems, described herein. However, various changes, modifications, and equivalents of the methods, products, and/or systems described herein will be apparent to an ordinary skilled artisan.

The present disclosure relates to a commercial waste container bottom assembly kit, capable of fitting a wide range of waste container and dumpster sizes. The system includes features such as an enhanced commercial waste container load rail and end caps which are included for both safety and durability reasons. The advantages over traditional methods of replacing container bottoms for odd size containers are significant.

Previously, specific-sized bottoms had to be fabricated, adding service time and cost to the refurbishing. With the disclosed bottom assembly kit, a container refurbisher conducting refurbishing's will be able to stock just a few sizes of the kit but, nevertheless, refurbish a wide range of designs and sizes of commercial waste containers or dumpsters. In addition, there will be significant savings in freight as the kit design allows for quantities to be nested into an optimal size for shipping, thus saving freight cost. In an effort to standardize replacement bottoms, a two-piece assembly capable of being sized to various containers is disclosed.

The pieces for the kits may be made of any material commonly used for a commercial waste container or dumpster. In one embodiment, steel is preferred, including roll-formed low carbon steel for the durable rail.

Figure 1A:
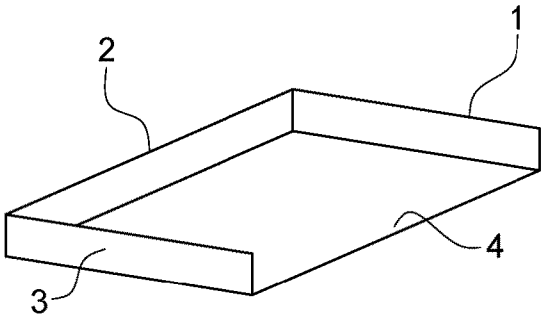
FIG. 1A shows an isometric view of one embodiment of a replacement bottom for kit.
Figure 1B:
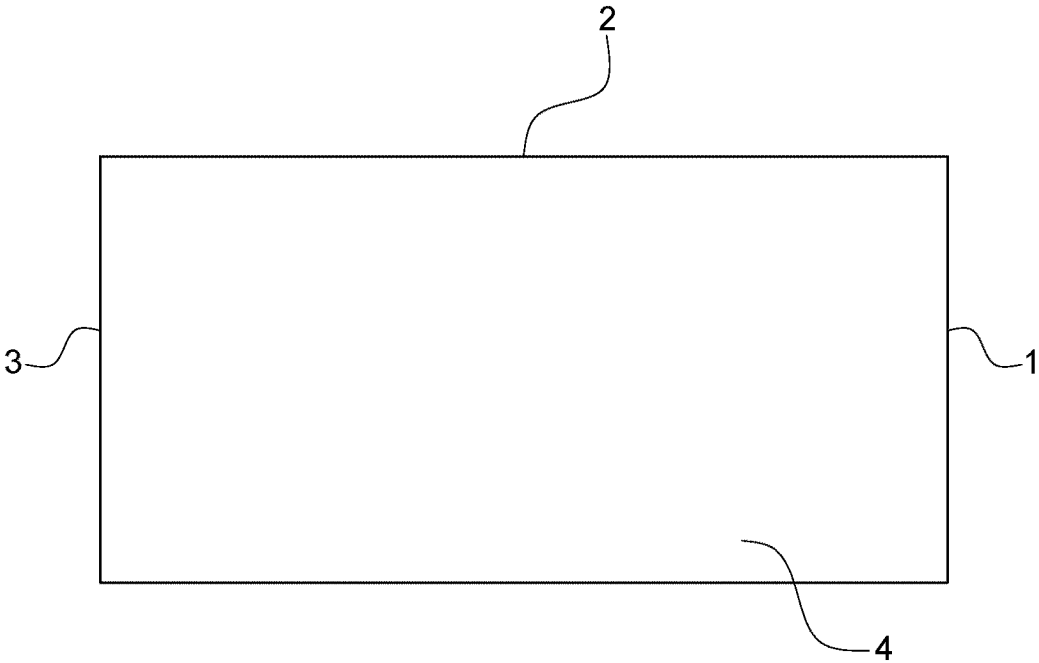
FIG. 1B shows one embodiment of a top view of a replacement bottom.
Figure 1C:
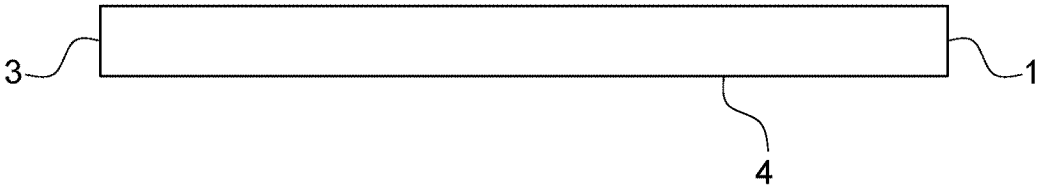
FIG. 1C shows one embodiment of a front view of a replacement bottom.

FIG. 1A shows a design for a bottom piece 1 for a kit for various container sizes. Bottom piece 1 includes sides 1, 2, and 3, and bottom 4. FIG. 1B shows a top view of bottom piece 1 for a kit shown in FIG. 1A. Sides 1, 2, and 3, can be provided in various lengths to suit various commercial waste container designs and sizes.

As one example, the length of side 2 may be about 73 inches and the length of side 3 may be about 36 inches to suit a particular, standard, commercial waste container size. In other embodiments, the length of side 2 may be about 73 inches and the length of side 3 may be about 54 inches to suit other, standard, commercial waste container sizes. The above dimensions are provided only as examples and a variety of lengths is contemplated in order to fit the wide variety of commercial waste container designs and sizes.

Figure 2B:
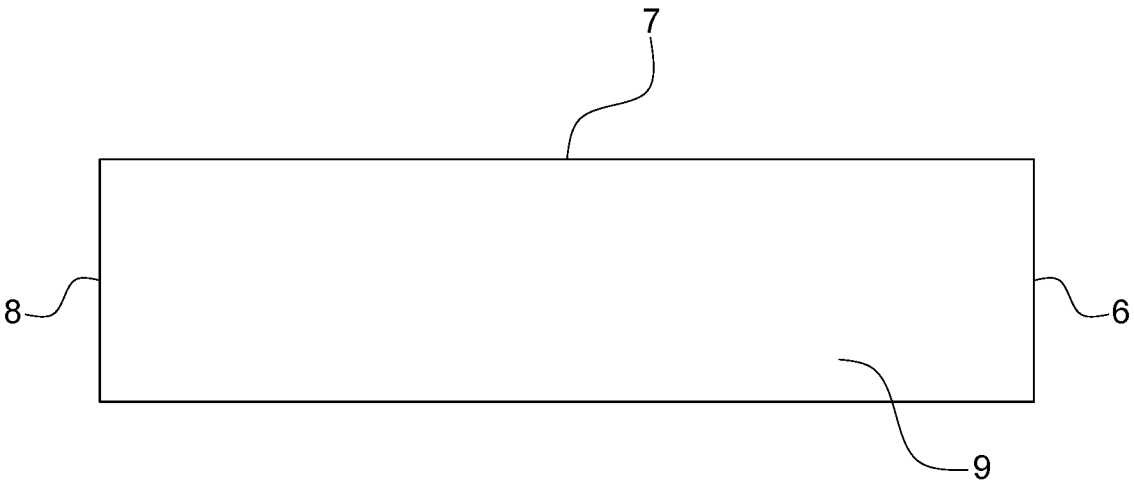
FIG. 2B shows a top view of one embodiment of a cap piece.
Figure 2C:
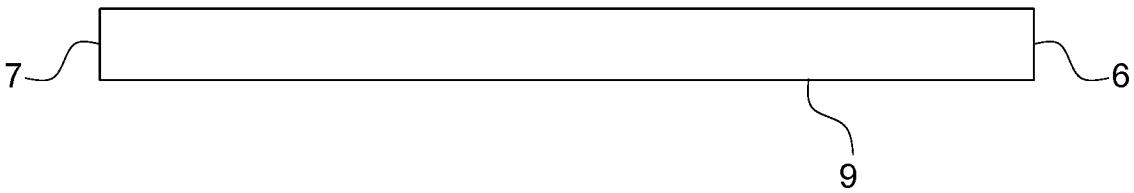
FIG. 2C shows a front view of one embodiment of a cap piece.
Figure 2A:
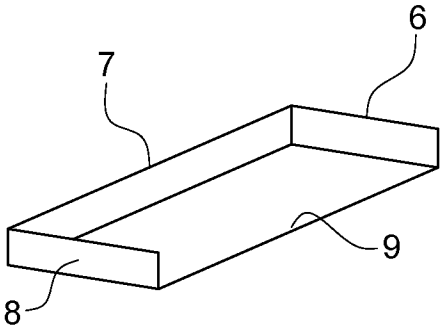
FIG. 2A shows an isometric view of one embodiment of a cap piece.

FIG. 2A shows a cap piece, with sides 6, 7, and 8, and bottom 9, which may be welded to bottom piece 1 once sized to the container. Cap piece can be moved to the exact size of a non-standard container and welded into the exact size as necessary.

FIG. 2B shows a top view of a cap piece. FIG. 2C shows a front view of a cap piece. In one example, side 7 of a cap piece may be about 72.5 inches and side 8 may be about 19 inches. The height of one of the sides 6, 7, or 8 may be about 6 inches. These dimensions are provided only as examples and a variety of dimensions are contemplated as appropriate.

Figure 3C:
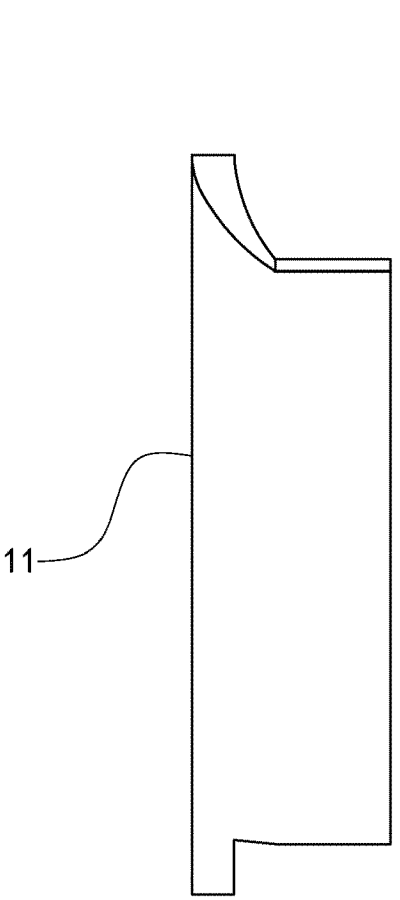
FIG. 3C shows a side view of one embodiment of an end cap.
Figure 3B:
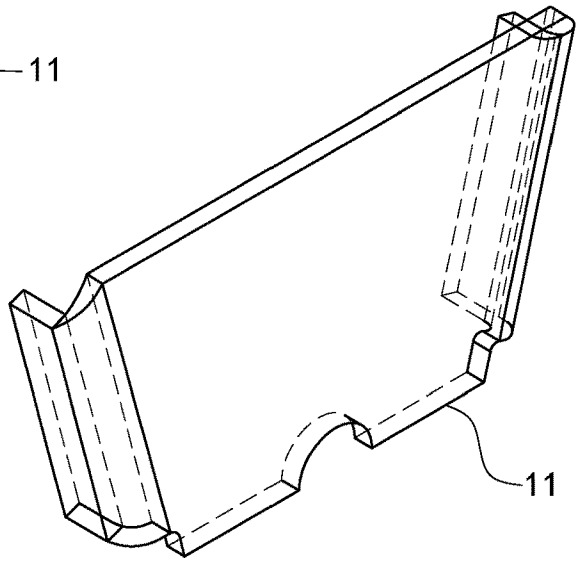
FIG. 3B shows a view of one embodiment of an end cap.
Figure 3A:
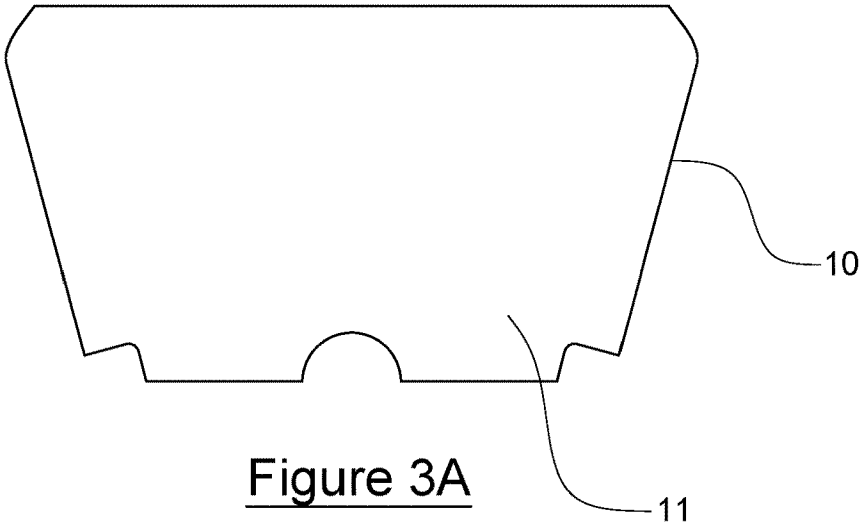
FIG. 3A shows a front view of one embodiment of an end cap.

FIG. 3A shows an enhanced commercial waste container load rail 10, with connected end caps 11, and which may be fixed to bottom piece 1. FIG. 3B shows a view of end cap 11. FIG. 3C shows a side view of end cap 11.

Figure 4C:
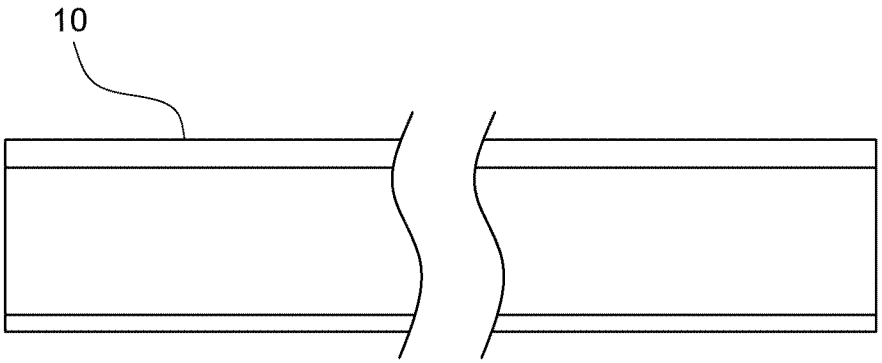
FIG. 4C shows a sectional view of one embodiment of the side of a rail.
Figure 4B:
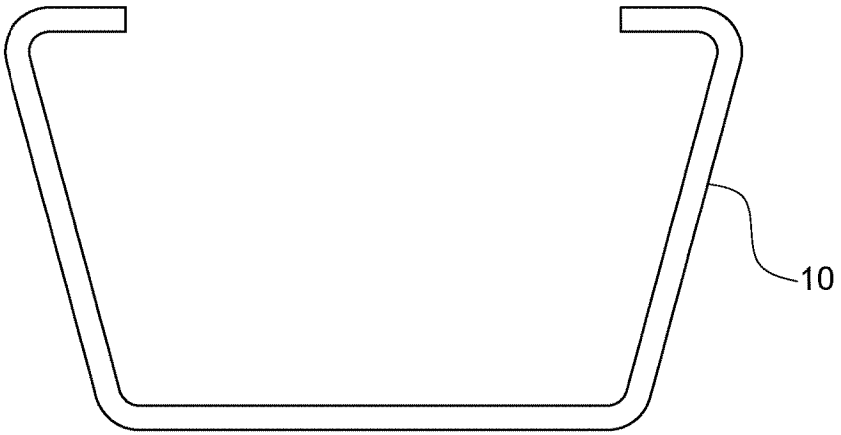
FIG. 4B shows a front view of one embodiment of a rail.
Figure 4A:
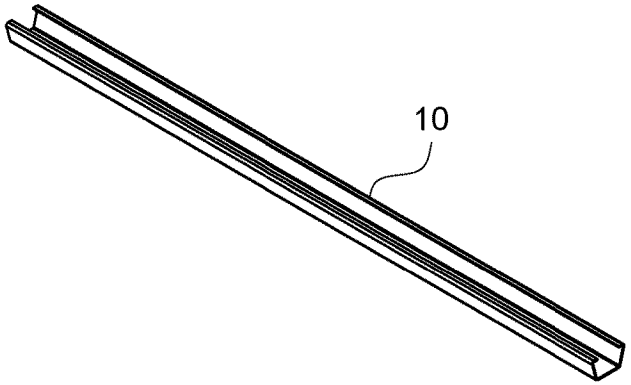
FIG. 4A shows an isometric view of one embodiment of a rail.

FIG. 4A shows an overview of the enhanced commercial waste container load rail 10. FIG. 4B shows a front view of load rail 10. FIG. 4C shows a sectional side view of load rail 10.

Figure 5B:
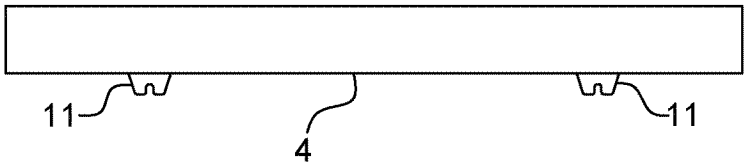
FIG. 5B shows a front view of one embodiment of an assembled enhanced commercial waste container with load rail.
Figure 5C:
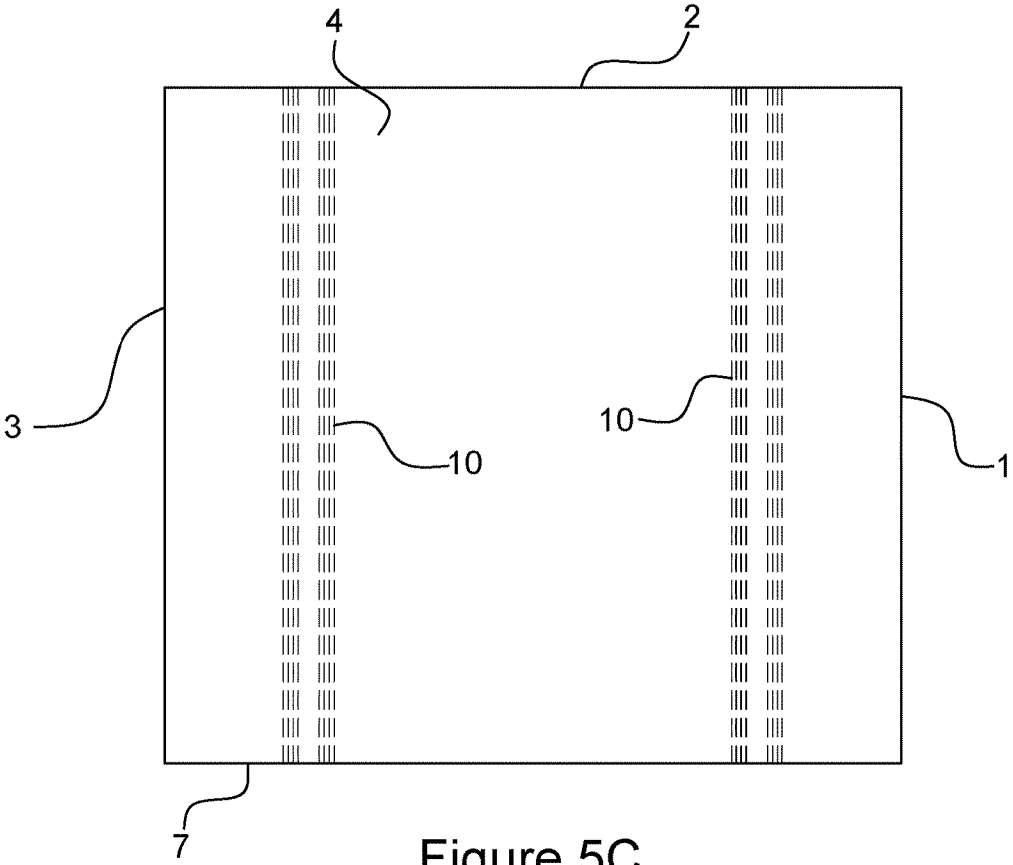
FIG. 5C shows a bottom view of one embodiment of an enhanced commercial waste container load rail assembled to a replacement bottom assembly.
Figure 5A:
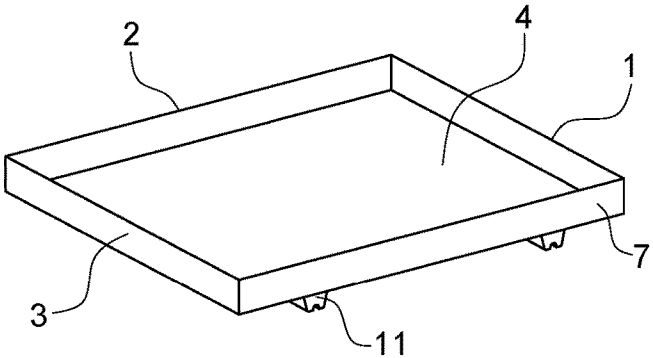
FIG. 5A shows one embodiment of an assembled enhanced commercial waste container with load rail.

FIG. 5A shows one embodiment of a replacement bottom kit assembly in assembled form including bottom piece 1, and a cap piece showing 2 rails and end caps. The preferred method of assembly is welding. FIG. 5B shows a front view of an assembled bottom kit assembly. FIG. 5C shows a bottom view of an assembled bottom kit assembly.

Figure 6C:
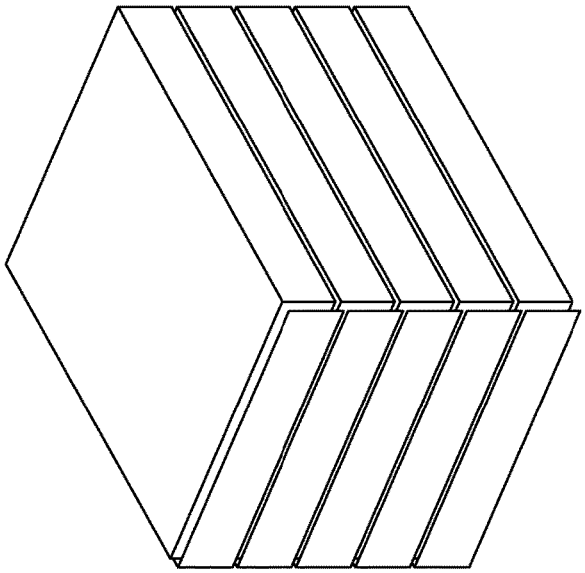
FIG. 6C shows a stack of 10 Universal Replacement Bottom Assembly Kits ready for shipment.
Figure 6B:
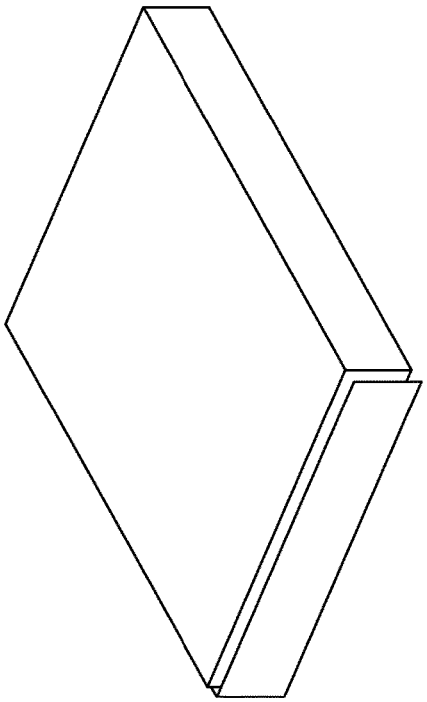
FIG. 6B shows another replacement bottom placed on top to create a nesting/stacking of 2 full Universal Replacement Bottom Assembly Kits.
Figure 6A:
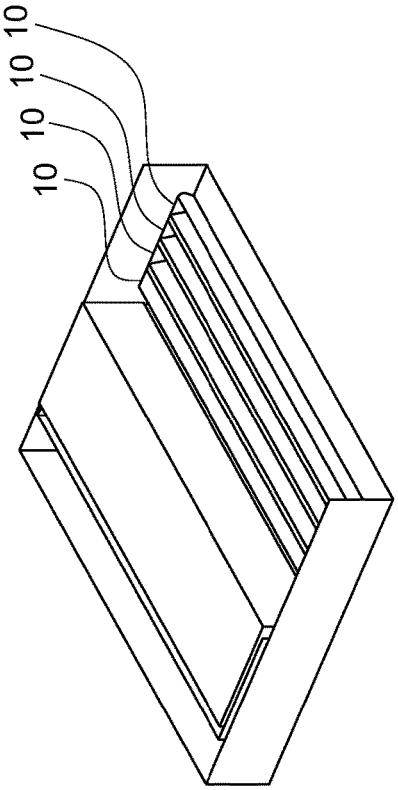
FIG. 6A shows how the end cap pieces are stacked inside replacement bottom with 2 rails.

FIG. 6A shows the stacking/nesting of two Universal Replacement Bottom Assembly Kits allowing for the 90% bends to maintain during shipping for ease of installing kit onto container by refurbisher, this view has one bottom cap 1 piece removed to show how the nesting of 4 rails 10 and 2 cap pieces occurs inside. FIG. 6B shows how the Universal Replacement Bottom Assembly Kits are combined in pairs of two nested inside 2 Bottom Piece 1 to minimize the footprint and freight costs. FIG. 6C show the completed bundle of 10 Universal Replacement Bottom Assembly Kits nested as 5 pairs stacked and ready for shipping.

While this disclosure includes specific examples, it will be apparent after an understanding of the disclosure of this application has been attained that various changes in form and details may be made in these examples without departing from the spirit and scope of the claims and their equivalents.

What is claimed is:

1. A replacement bottom kit for a waste container or dumpster comprising:

a dumpster bottom piece comprising low carbon steel comprising a bottom and three sides;

a cap piece comprising low carbon steel comprising a dumpster bottom and three sides;

one or more dumpster rails comprising low carbon steel capable of attachment to the dumpster bottom piece;

wherein the cap piece is configured to be movable to fit the size of a bottom of the waste container or dumpster and is capable of being welded to the dumpster bottom piece to fit the bottom of the waste container or dumpster.

2. The replacement bottom kit for a waste container or dumpster of claim 1, wherein a side of the dumpster bottom piece is approximately 73 inches long and the other two sides of the dumpster bottom piece are between approximately 36 inches to approximately 54 inches long.

3. The replacement bottom kit for a waste container or dumpster of claim 2, wherein two sides of the dumpster bottom piece are approximately 36 inches long.

4. The replacement bottom kit for a waste container or dumpster of claim 2, wherein two sides of the dumpster bottom piece are approximately 54 inches long.

5. The replacement bottom kit for a waste container or dumpster of claim 2, wherein one side of the cap piece bottom is approximately 72.5 inches long.

6. The replacement bottom kit for a waste container or dumpster of claim 5, wherein two sides of the cap piece are approximately 19 inches long.

7. The replacement bottom kit for a waste container or dumpster of claim 5, wherein a height of a side of the dumpster bottom piece or the cap piece is approximately 6 inches high.

8. The replacement bottom kit for a waste container or dumpster of claim 1, further comprising end caps configured to fit on an end of a dumpster rail.

9. The replacement bottom kit for a waste container or dumpster of claim 1, wherein the dumpster bottom piece, cap piece and dumpster rails comprise steel.

10. The replacement bottom kit for a waste container or dumpster of claim 1, wherein the dumpster bottom piece bottom is in a rectangular shape.

11. The replacement bottom kit for a waste container or dumpster of claim 1, wherein the kit may be nested into a compact configuration for shipping.

12. The replacement bottom kit assembly for a waste container or dumpster of claim 1, wherein the kit is configurable to replace the bottom of a non-standard commercial waste container or dumpster.

13. A replacement bottom kit for a waste container or dumpster comprising:

a dumpster bottom piece comprising low carbon steel of a rectangular shape comprising a dumpster bottom with one side approximately 73 inches long and two other sides between approximately 36 inches and approximately 54 inches long configured to be at approximately 90° angles to the dumpster bottom;

a cap piece comprising low carbon steel of a rectangular shape comprising a dumpster bottom with one side approximately 72.5 inches long and three sides configured to be at approximately 90° angles to the cap piece bottom;

one or more dumpster rails comprising low carbon steel capable of attachment to the dumpster bottom piece;

wherein the cap piece and dumpster bottom piece are configured to be movable to fit to the size of the bottom of the waste container or dumpster and welded to attach to the bottom of the waste container or dumpster.

14. The replacement bottom kit for a waste container or dumpster of claim 13, wherein a height of a side of the dumpster bottom piece and a side of the cap piece is approximately 6 inches high.

15. The replacement bottom kit for a waste container or dumpster of claim 13, further comprising an end piece configured to fit on an end of a rail.

16. The replacement bottom kit for a waste container or dumpster of claim 13, wherein the dumpster bottom piece two other sides are approximately 36 inches long.

17. The replacement bottom kit for a waste container or dumpster of claim 13, wherein the dumpster bottom piece two other sides are approximately 54 inches long.

18. The replacement bottom kit for a waste container or dumpster of claim 13, wherein the dumpster bottom piece two other sides are approximately 48 inches long.

19. The replacement bottom kit for a waste container or dumpster of claim 13, wherein a side of the cap piece is approximately 19 inches long.

* * * * *